US007854211B2

(12) United States Patent
Rixford

(10) Patent No.: US 7,854,211 B2
(45) Date of Patent: Dec. 21, 2010

(54) PORTABLE BOAT IN NESTING SECTIONS, WITH WATERPROOF FABRIC COVER INCORPORATING A STABILIZING KEEL

(75) Inventor: Ellen Sue Rixford, New York, NY (US)

(73) Assignee: Ellen S. Rixford, New York City, NY (US)

( * ) Notice: Subject to any disclaimer, the term of this patent is extended or adjusted under 35 U.S.C. 154(b) by 175 days.

(21) Appl. No.: 12/231,849

(22) Filed: Sep. 8, 2008

(65) Prior Publication Data

US 2010/0058971 A1 Mar. 11, 2010

(51) Int. Cl.
*B63B 7/00* (2006.01)

(52) U.S. Cl. ..... 114/353

(58) Field of Classification Search ..... 114/343, 114/347, 352, 353, 354, 355, 361, 364
See application file for complete search history.

(56) References Cited

U.S. PATENT DOCUMENTS

| | | | |
|---|---|---|---|
| 276,026 | A | 4/1883 | Goodrich |
| 1,916,093 | A | 6/1933 | Cormien |
| 2,957,010 | A | 12/1948 | Thedick |
| 3,916,468 | A | 11/1975 | Tetreault et al. |
| 3,996,635 | A | 12/1976 | Wilkes et al. |
| 4,274,170 | A | 6/1981 | Simpson |
| 4,290,157 | A | 9/1981 | Jensen, Jr. |
| 4,453,484 | A | 6/1984 | Englund |
| 4,597,348 | A | 7/1986 | Jonas |
| 4,841,899 | A | 6/1989 | Fleckles et al. |
| D343,437 | S | 1/1994 | De Paoli |
| 5,331,915 | A | 7/1994 | Snyder |
| 5,511,507 | A | 4/1996 | Allen |
| 5,921,197 | A | 7/1999 | Wagner |
| 5,964,178 | A | 10/1999 | Gonda |
| 6,615,762 | B1 | 9/2003 | Scott |
| 6,779,477 | B2 | 8/2004 | Lockwood |
| 7,143,715 | B2 | 12/2006 | Howlett |
| 2004/0011275 | A1 | 1/2004 | Broom |

OTHER PUBLICATIONS

Peter Kaupat, Easy Rider, Website Advertisement Take-Apart Kayaks—1st 2 pages, pub U.S.A. Internet.

*Primary Examiner*—Daniel V Venne

(57) ABSTRACT

The present invention introduces a small boat (kayak or hybrid kayak-canoe) made in a plurality of nesting sections. It is covered with a waterproof fabric cover, incorporating a stabilizing and flexible keel sewn into it. The boat also has a releasably attachable and flexible coaming.

5 Claims, 11 Drawing Sheets

Figure 2:
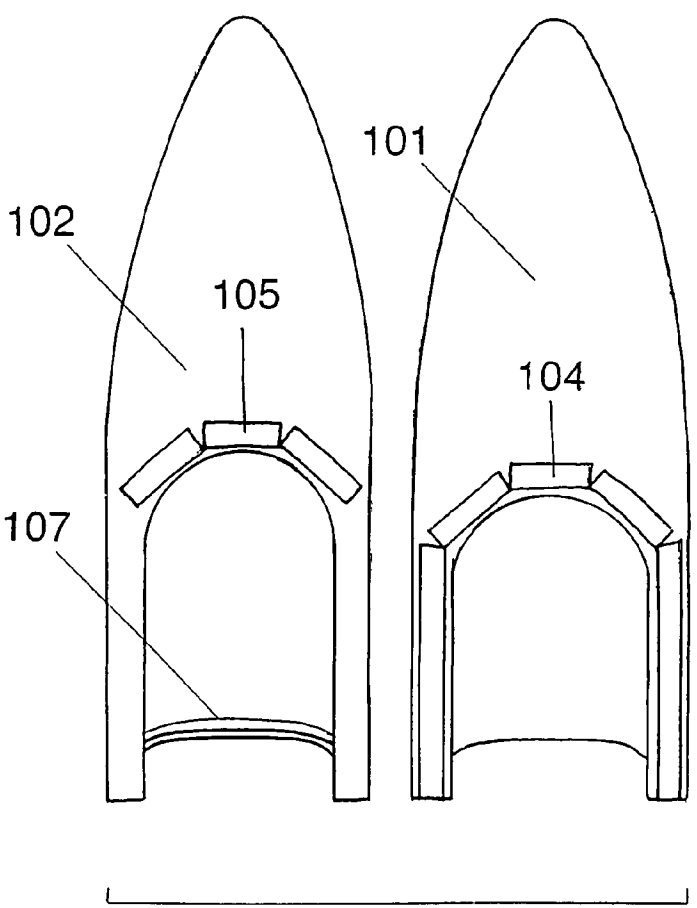

PORTABLE BOAT IN NESTING SECTIONS, WITH WATERPROOF FABRIC COVER INCORPORATING A STABILIZING KEEL

SUMMARY

The present art results in a boat that is small, slender, light, fast, easy to maneuver, stable, safe, strong, resistant to damage, comfortable, easy to put together and cheap to manufacture. It is a boat made in nesting sections, two for the first embodiment, three for the second, a hard shell boat inside a waterproof fabric cover, but with a difference. Because of the stabilizing keel sewn into the cover as an integral part of it, the boat can be built with slender proportions relative to its length. The slender proportions are what make it fast and maneuverable; the keel is what makes if highly resistant to rolling and tipping, and therefore safer than most small recreational watercraft of a similar size.

Because both hull sections are aerodynamically smooth and rounded inside and out, with only one rib across, the boat is comfortable to sit in, needing no extra floor boards, and offering plenty of space fore and aft to carry supplies and baggage. The materials suggested: fiberglass and resin for the hard hull and vinyl covered polyester for the cover, are durable and resistant to damage. They are also relatively inexpensive. The small number of parts: two or three hull parts, a cover, a coaming plus standard fasteners, such as bolts, make fabrication simpler than most portables. The small size and extremely light weight make the boat ideal for the paddler who must use public transportation, and who has limited storage space, time, and money.

BACKGROUND OF THE INVENTION

Small portable boats have been around for hundreds of years. But boats that can be taken apart for easier portability and storage have been patented throughout the last century. The problems addressed by inventors of portable boats are the following:

1. Portability and Convenience: Major factors here are: size, especially size when in portage or storage mode. weight, and ease of assembly.
2. Safety: Major factors here are: stability, durability, and ease of repair.
3. Cost: in order to make small portable boats available to the public, inventors must consider kinds and costs of materials, ease of fabrication, including number and simplicity of manufacturing steps, and ability to adapt methodology to make various kinds and sizes of boat configurations to fit customers' needs.

As technology has offered us new materials and innovations in fabrication methods, lighter and more efficient boats have come into being. Among the many solutions to the above mentioned problems, here are some relevant to present art, together with their advantages and disadvantages. The topics covered are: boats in nesting parts or sections; multi-sectional boats; skin-on-frame, or skinboats; collapsible hard hull boats with fabric covers; keels, centerboards, and skegs for stabilizing small watercraft; and releasably attachable coamings.

DESCRIPTION OF THE PRIOR ART

Boats in nesting parts: in these, the components fit into, and are contained, one within the other, for portage and storage. Early versions, dating from 1933 to 1976, U.S. Pat. Nos. 1,916,093, 2,457,010, and 3,996,635, were made of wood, and were probably quite heavy. Their forms were either that of a small dinghy, very wide in the beam, or a rectangular fishing platform, also fairly wide. In either configuration, they would not be aerodynamic, i.e. fast or maneuverable, and would be suitable only for very calm water conditions. Given today's advances in technology, they would be impractical to make and sell.

Multi-sectional boats: these are divided into discrete sections which are held separate, not nested or collapsed, and are then fastened together for use. The idea here is to cut a longish boat into sections, wall off the cut ends, and fasten them together again. Relevant designs are: U.S. Pat. No. 3,916,468, a sectional canoe in two parts where one side locks into the other via male-to-female wedges in the cut ends, and an unpatented but actively marketed line of kayaks called Easy Rider Take Apart Kayaks. These were designed and are sold by Peter Kaupat, and advertised on the Internet. The main disadvantage of all of these is that, while they cut down on overall length, since they take a long boat and cut it into halves or thirds, they do not cut down on volume or weight, as one still must deal with a standard boat, albeit cut into pieces. Manufacturing costs would be somewhat higher than for a regular one piece boat, as one must deal with making the several sections watertight, and create a means for fastening them together snugly and stably.

Skin-on-Frame or Skinboats: These are by far the most commonly available portables, and have the longest history. Invented by Arctic dwellers as fishing and hunting boats, (called baidarkas) they are made by stretching a "skin" or cover, of waterproof material over a skeleton, or framework of wood or bone, in the case of the earliest designs, or aluminum or carbon fiber, in the case of the most modern ones. Many versions have been patented; I will offer what I consider the most relevant, giving an overview of prior art in this category. One of the earliest, U.S. Pat. No. 833,846, is a skinboat whose frame is made of wood, gas pipes, and heavy wire threaded through pockets in a canvas skin. Some sixty years later, U.S. Pat. No. 4,124,910 presents a dinghy, a rather broad, tublike structure made of tubes covered with waterproofed fabric. From there, new materials and increased ingenuity brought us U.S. Pat. No. 4,274,170, a collapsible kayak whose hinged framework can reconfigure into a backpack structure. U.S. Pat. No. 4,290,157 introduces a canoe-like boat whose stringers, or longitudinal members fit together telescopically. U.S. Pat. No. 4,761,889 goes one better with a collapsible seagoing canoe/sailboat. From there, innovations in skinboat structure are relatively minor. A complex system of joints holding together a wood frame, (U.S. Pat. No. 4,841,899) the addition of air bladders on the gunwales between the frame and the cover, to enhance rigidity (U.S. Pat. No. 5,964,178) a skinboat where the stringers are held together by male-to-female joints, and variable tensioning changes the angle, or rocker, of front and rear to the horizontal of the hull bottom—this to enable the kayaker to transition from regular to white water conditions. One of the most recent, patent #2004/0011275A1, employs members held together by shock cords and slidable ribs to expand and contract the form of the kayak and allow it to be more easily inserted into its cover.

Of all the forms of collapsible boat the skin-on-frames seem to be the most common and the most successful commercially. They are lighter than multi-sectionals, and break down into more manageable packages for portage and storage. New materials, like carbon fiber frames and covers with waterproof coatings made of industrial paints, have made them strong, though not as strong as hard-hull boats, and fairly portable. But they have disadvantages, the most serious of which is the puncture problem. A sharp rock, or a pointed piece of submerged metal, can spell instant disaster, as pressure will force water strongly into the void inside a boat. Repairs mid-voyage are difficult, as the fabric must be dried out in order to apply a glue patch or duct tape. Skinboats must be constantly inspected for weakness or deterioration in the skin cover and the components and fasteners. Other less serious, but still annoying features are: the sheer number of component parts and fasteners involved, some of which invariably get lost; the complexity and assembly time needed, and the need to reassemble the boat once one gets back home in order to dry out the skin so its dampness won't encourage mold. Assembling and disassembling the boat is troublesome enough without having to do it all over again at home, leaving a fully assembled boat sitting around in the middle of the living space for many hours while it dries out. In terms of the boat's handling and design, framed boats are susceptible to excessive hull flexure, where the hull shape distorts due to ambient water pressure, causing drag, and slowing the paddler down. The use of inflatable air bladders to enhance rigidity also enhances weight and cost. Skinboats do tend to be much more expensive than non-collapsibles, and they are not as durable, or as safe.

Which brings us to the hard hull with waterproof cover. These are rare. Actually I have found only one of them U.S. Pat. No. 6,615,762 B1, several embodiments of the same idea: kayaks and canoes made of a plurality of flat sections of corrugated plastic, each section having flanges which are bolted to neighboring sections. The corrugated plastic multipiece watercraft has some advantages over other portable boat designs. The corrugated plastic is light weight, rigid, and strong, and the separate pieces pack up into a smaller package than most portables. Unfortunately it does not altogether solve the issues of convenience. There are more than twenty separate pieces per boat, each having a foldable hinge in the middle, and a flange at each of its four edges. Each of the four flanges times twenty-plus pieces have several bolts to tighten. That is a lot of bolts. The directions for assembly, available on the internet under the names: Foldlite and Boat in a Bag are about twenty pages long. The many interior flanges create multiple ribs which would cut into the paddler's legs, and make the interior space uncomfortable and inconvenient for storage of equipment and supplies. Another issue is speed and maneuverability. The configuration of the smaller and more portable boats, (kayaks) while having a reasonably smooth profile despite the faceted outline, is still rather big in the beam, a flaw shared by most small watercraft. Small size means instability unless the width of the boat is sufficient to insure against tipping. A wider proportion means a slower, less maneuverable boat, one that is less fun to paddle, and takes longer to get where one is going.

The solution to this problem was my invention of a keel sewn into the fabric of the cover. I will elaborate my invention in the Detailed Description of the Invention section, but for now, I must summarize prior art as relates to keels, and their close relations, centerboards and skegs for small watercraft.

Keels, of course, have been around almost as long as there have been boats. They are used to stabilize boats, particularly top-heavy ones, like sailboats, which can be blown over without the keel's weight and under-boat resistance to water pressure. A keel, centerboard, or skeg, (which is a much smaller, shorter, version of a keel, can also help a small boat to track better, making paddling more pleasant and easy. Keels come in all shapes and sizes and degrees of complexity, especially for larger watercraft. But I will limit prior art research to relatively simple very small craft inventions, (as for canoes and kayaks,) since that is what the present art is. U.S. Pat. No. 276,026, an early and simple centerboard, hangs vertically below the boat, and can be controlled and manipulated from within it. A similar but a bit more complex keel, this time combined with a rudder in U.S. Pat. No. 4,453,484, like the first one, and like many of its kind, swings round an axis under the hull and parallel to it, and can also be manipulated from within the boat. Both of these must be made integral to the boats they are on, not added to them as an afterthought. The keel in U.S. Pat. No. 4,597,348 is a detachable single or double keel which can be added on to an existing canoe or kayak via a set of brackets and straps secured to the boat above the water line. The invention mentions the possible use of flexible materials and a swinging axis to make the keel easier to handle when the boat is beached. Other stabilizing devices which can be added to existing small boats are: U.S. Pat. No. 343,437, a design patent for an attachable small spoonlike skeg, U.S. Pat. No. 5,921,198, a plastic plate keel, rather resembling a French curve, which can use the web and grommet construction of an inflatable kayak to attach it, and even has a post for a little outboard motor, and last, U.S. Pat. No. 7,143,715 B2, an outboard skeg, which is in actuality a pair of little fins attachable to a small framework which is itself attachable to the back of a boat.

All these devices seek to make a boat steer better, balance better, and stabilize better. But because they are mostly add-ons of rigid, hard material, they add to weight and bulk, and must be purchased separately from the boat. Many of them are too small to make much of a difference in performance. And because they are added to an existing boat, they can have no beneficial effect on the boat's dimensions.

The last bit of technology to discuss is the coaming, or the dimensional ring around a kayak's cockpit edge. The purpose of the coaming is to reduce water splashing into the boat by erecting a little barrier around the boat opening. Most coamings are built right into boats as part of their structure. But the present invention, a boat made in nesting sections, where one section must slide smoothly into the other with minimal space between, cannot have a built-in raised coaming, as it would interfere with the fit between sections. The solution is a removably attachable ring-shaped coaming, made of soft, springy, flexible material, like thick walled foam rubber tubing, slit around the outer edge; a coaming which can be fitted snugly around the inner opening of the cockpit, and taken off and stowed when not in use. Prior art for removable and soft, flexible coamings and any related structures is limited to nonexistent. The closest are sprayskirt assemblies (fabric protective covers attached to a coaming's edge) and meant to be used in extremely splashy conditions, such as white-water boating. Some, like U.S. Pat. Nos. 5,331,915 and 5,511,507 incorporate a drytop, or a waterproof jacket built into the sprayskirt assembly and meant to keep the paddler dry no matter what. Another, U.S. Pat. No. 5,367,975 discloses only a very tightly fastened sprayskirt, and U.S. Pat. No. 6,779,477 B2 presents an improved cockpit and coaming design, but with the elements all made of hard materials. I have found no prior art which closely relates to the present art coaming feature.

DRAWINGS, BRIEF DESCRIPTION

Figure 1B:
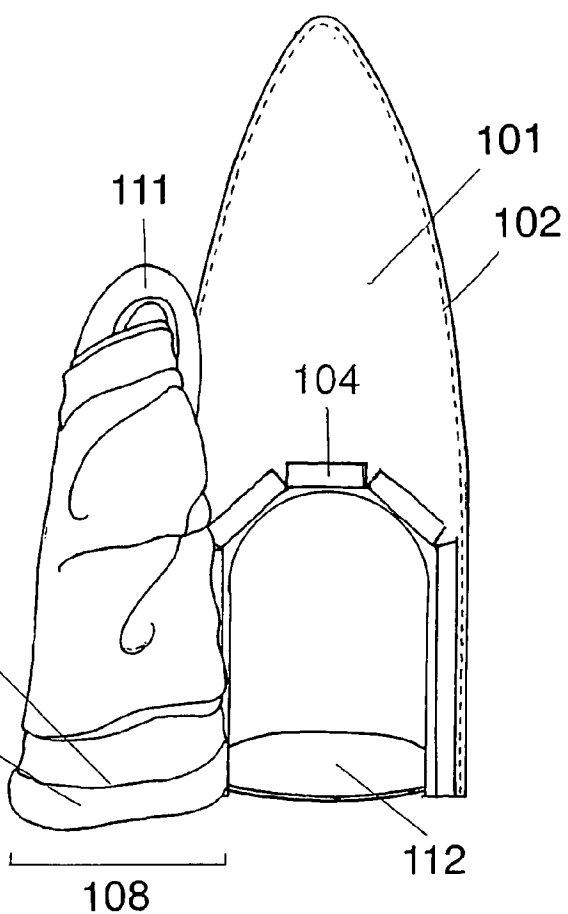
Figure 1A:
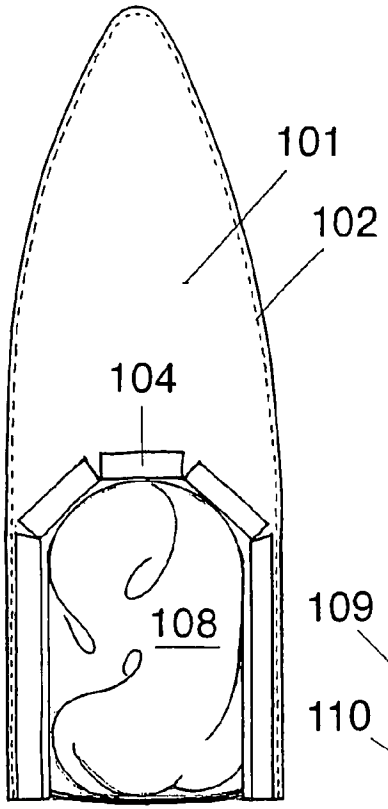

FIG. 1*a* Frontal view of the first embodiment, compactly packed up for storage or transport. Visible are the hard hull sections of the boat. Stern section, which is slightly smaller in all dimensions than the prow section, is nested inside the prow section; soft, flexible waterproof fabric cover, coaming, paddles, and all needful equipment are rolled up and stowed inside, on the "floor" resting on the stern rib, a thin piece of plywood or other hard, rigid material, permanently attached around the inner edge of the stern section. Hook and loop strips are attached around the cockpit edge, as a means for attaching the fabric cover to the hard shell hull.

FIG. 1*b* Frontal view as above, of the first embodiment, prow section, with stern section nested within it, showing floor piece laid on top of the rib at the bottom of the stern section. Contents: fabric cover, coaming etcetera, have been removed and set on the side to show the floor piece.

FIG. 2 Frontal view of the first embodiment's prow and stern section, side by side. Note that the stern section is only a tiny bit smaller than the prow. The stern section also has hook and loop strips around the cockpit edge, as a means for securing the fabric cover to it. The two-section boat, or first embodiment, is designed like a kayak.

Figure 3:
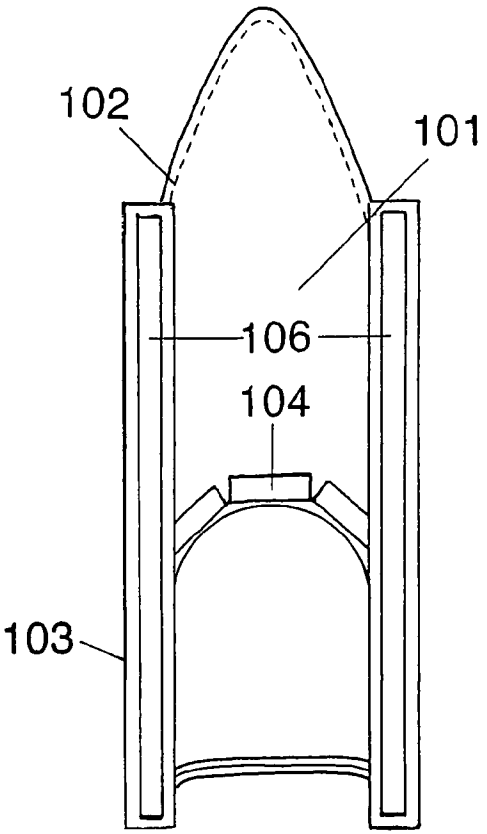

FIG. 3 Frontal view of the second embodiment's hard hull prow, stern, and middle sections, nested together. The middle section is made very slightly larger than the prow section in cross-section, so that the prow and stern sections can nest within it for transport and storage. Hook and loop strips as a means for attaching the fabric cover to the middle section are attached to each of its side edges. The three-section, or second embodiment configuration, makes for a proportionally longer deck opening, this boat could be considered a hybrid between a kayak and a canoe, or "kayacanoe."

Figure 4:
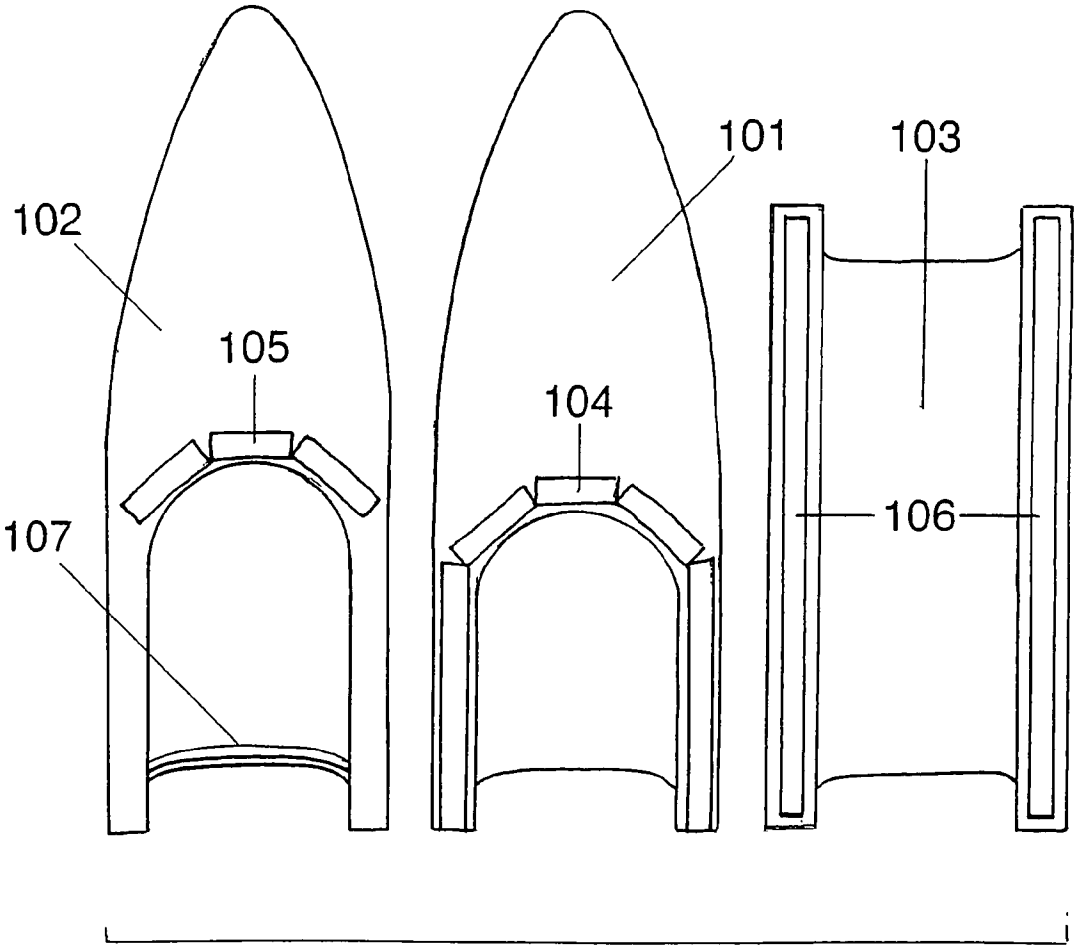

FIG. 4 Frontal view of the second embodiment's prow, stern, and middle sections, side by side. Cross-sectionally, the middle section is largest, next the prow section, next the stern section, which is dimensionally the smallest.

Figure 5:
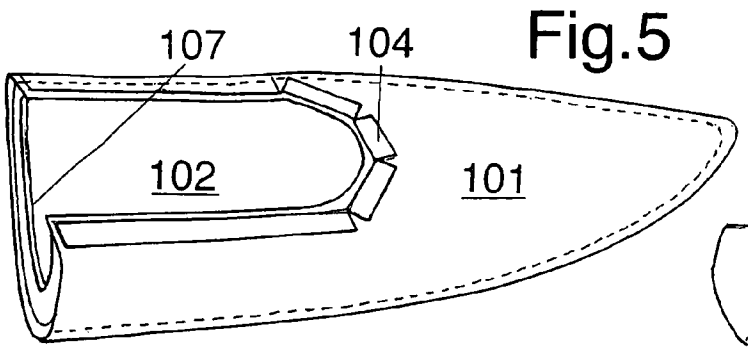

FIG. 5 Perspective view, from port side, of first embodiment, stern section completely nested within prow section.

Figure 6:
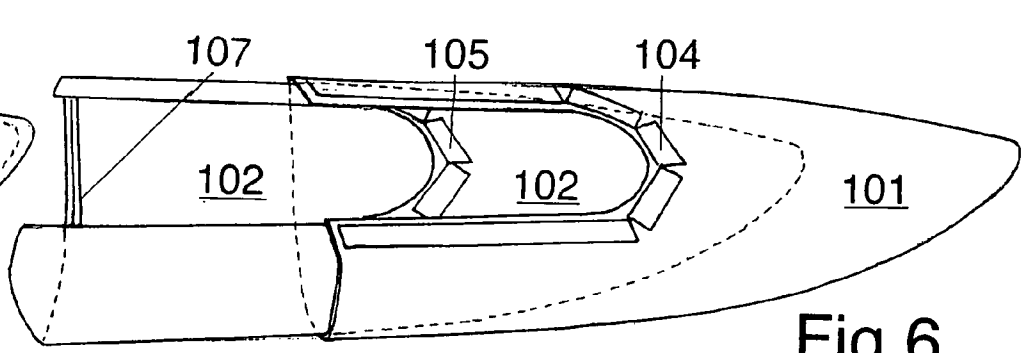

FIG. 6 Perspective view from port side of first embodiment, stern section partially slid out from prow section.

Figure 7:
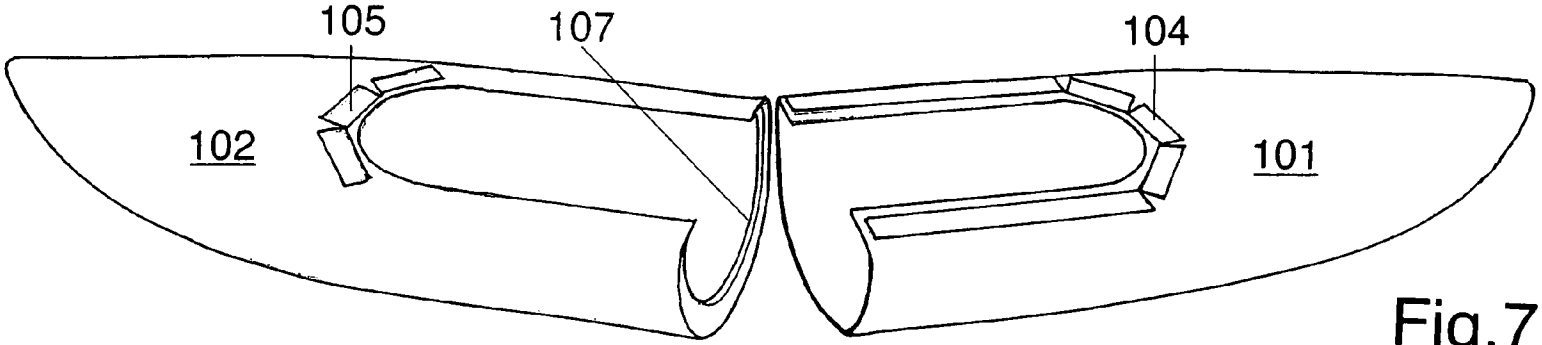

FIG. 7 Perspective view from port side of first embodiment, stern and prow sections in place ready to be overlappingly slid together and joined for use.

Figure 8:
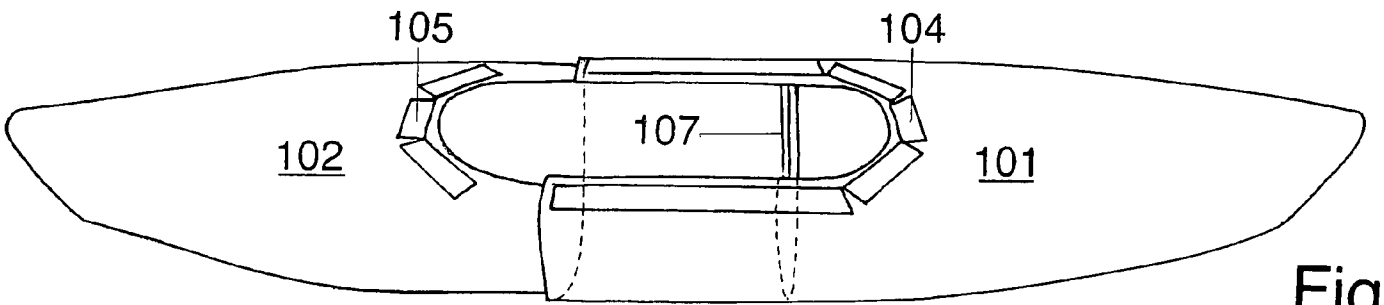

FIG. 8 Perspective view from port side of first embodiment, stern and prow sections joined, or slid overlappingly together, ready for use.

Figure 9:
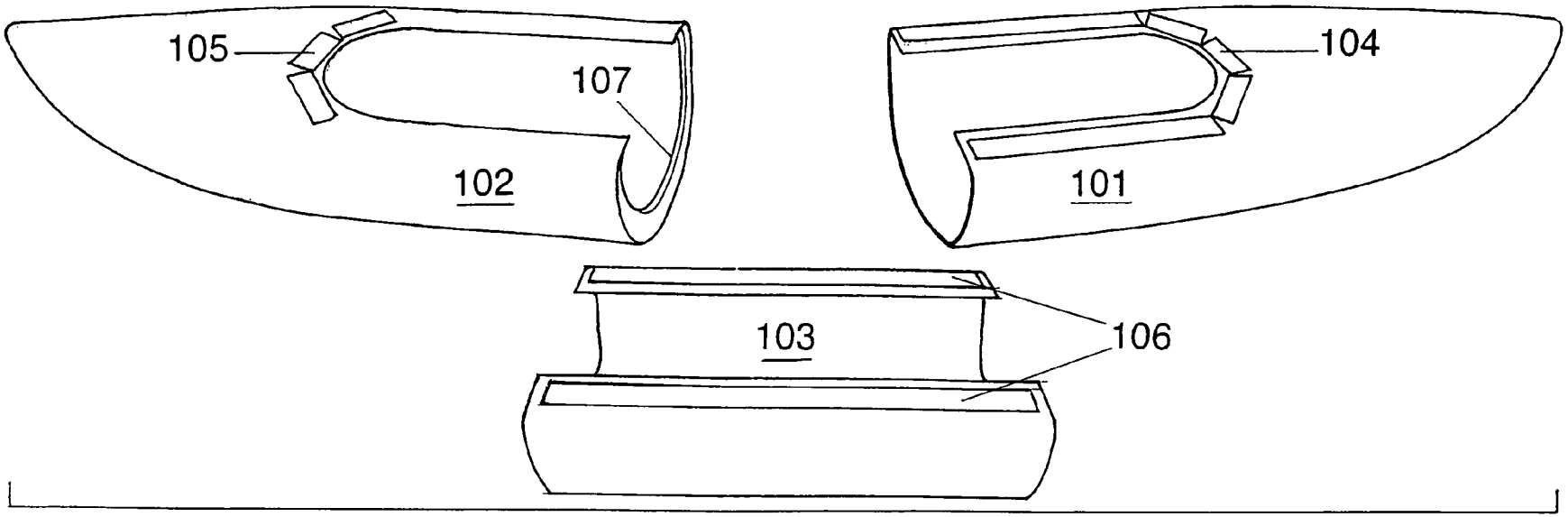

FIG. 9 Perspective view from port side of second embodiment, stern, middle, and prow sections in place, ready to be joined together.

Figure 10:
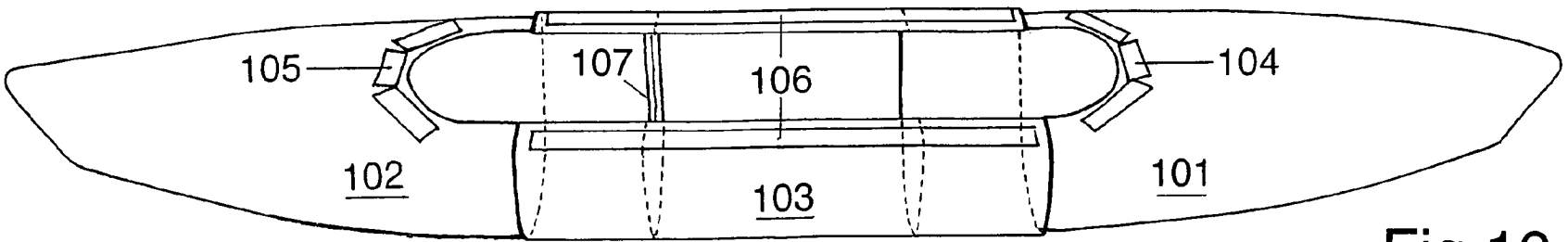

FIG. 10 Perspective view from port side of second embodiment, stern, middle, and prow sections joined, or slid overlappingly together, ready for use.

Figure 11:
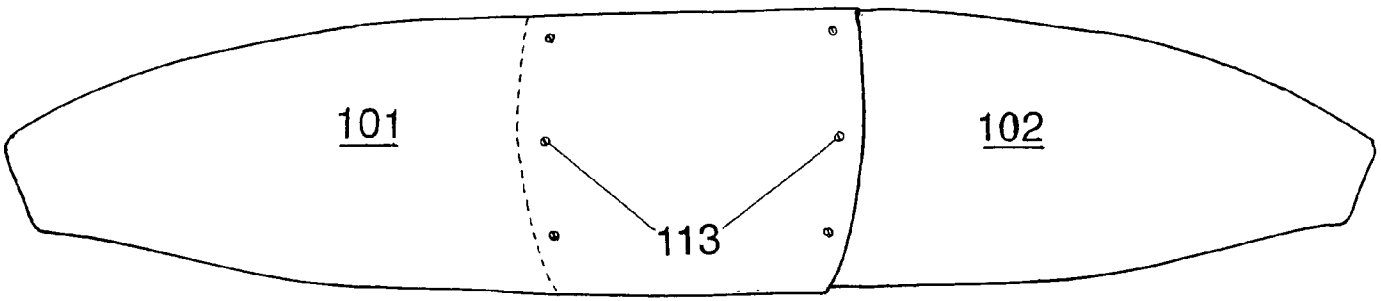

FIG. 11 View of the bottom, first embodiment, from starboard side showing fasteners, which could be bolts with wing nuts, holding two sections, prow and stern, together.

Figure 12:
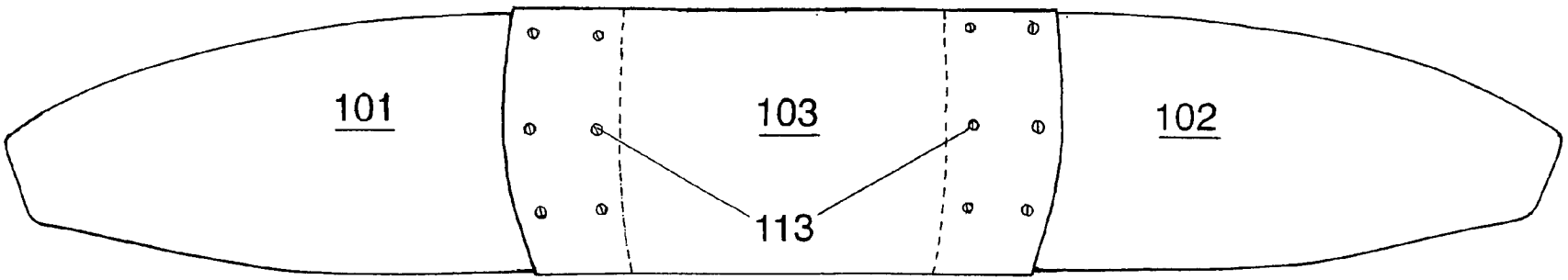

FIG. 12 View of the bottom, second embodiment, from starboard side, showing fasteners, which could be bolts with wing nuts, holding the three sections, prow, middle, and stern, together.

Figure 13:
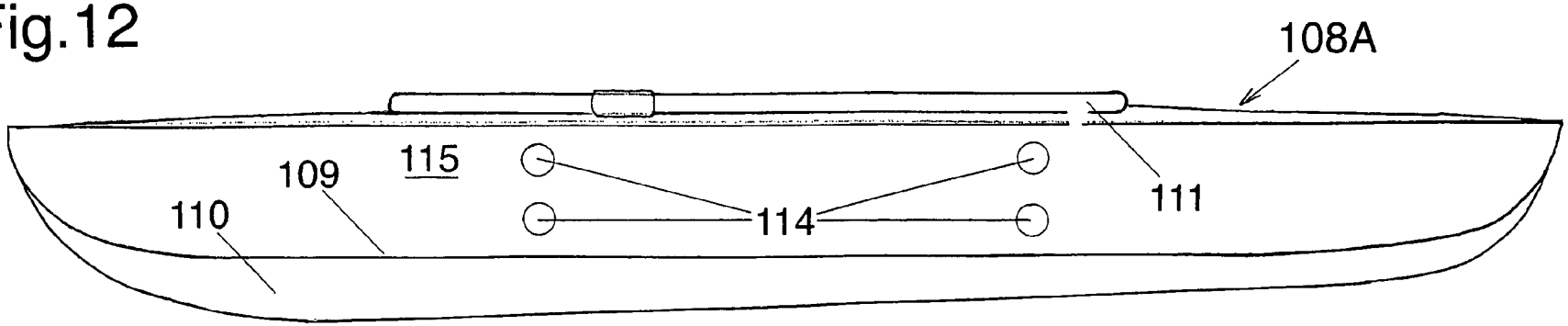

FIG. 13 Port side view of second embodiment, with cover on and coaming in place, showing the seam joining right and left halves of the cover, and separating the body of the cover from the flexible stabilizing fabric keel, which is made from the seam allowance of the above-mentioned seam. Also shown are reinforcing waterproof fabric spots made of a heavier grade of fabric, preferably attached, or glued, inside and outside the cover, as a means for protecting against rubbing by fasteners against the cover.

Figure 14A:
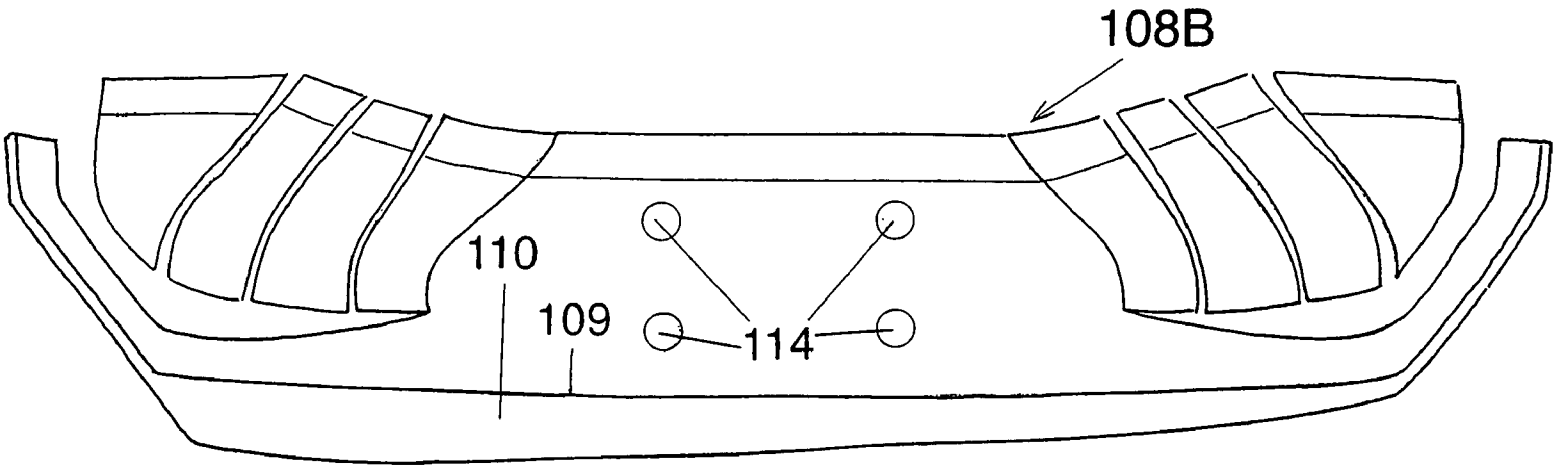

FIG. 14*a* Pattern for waterproof fabric hull cover, right and left sides, 2 section boat or first embodiment. The pattern is straight at the middle of the hull, following the configuration of the boat, and has two "arms" or end pieces, the seam following the profile of the bottom of the boat. A plurality of separate fitted and overlapping pieces configure the cover, at front and back, right and left sides, to the curvature of the hull. Thin line at upper part of pattern pieces shows edge where hull pieces join to deck pieces.

Figure 14B:
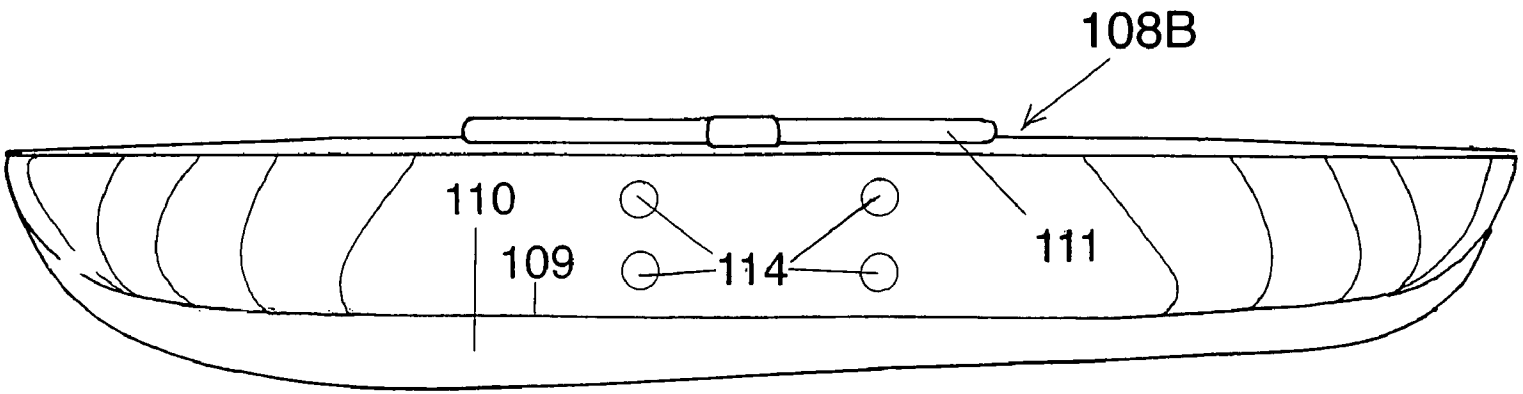

FIG. 14*b* The waterproof fabric cover, completed, and on the boat, and with coaming in place, seen from port side.

Figure 15A:
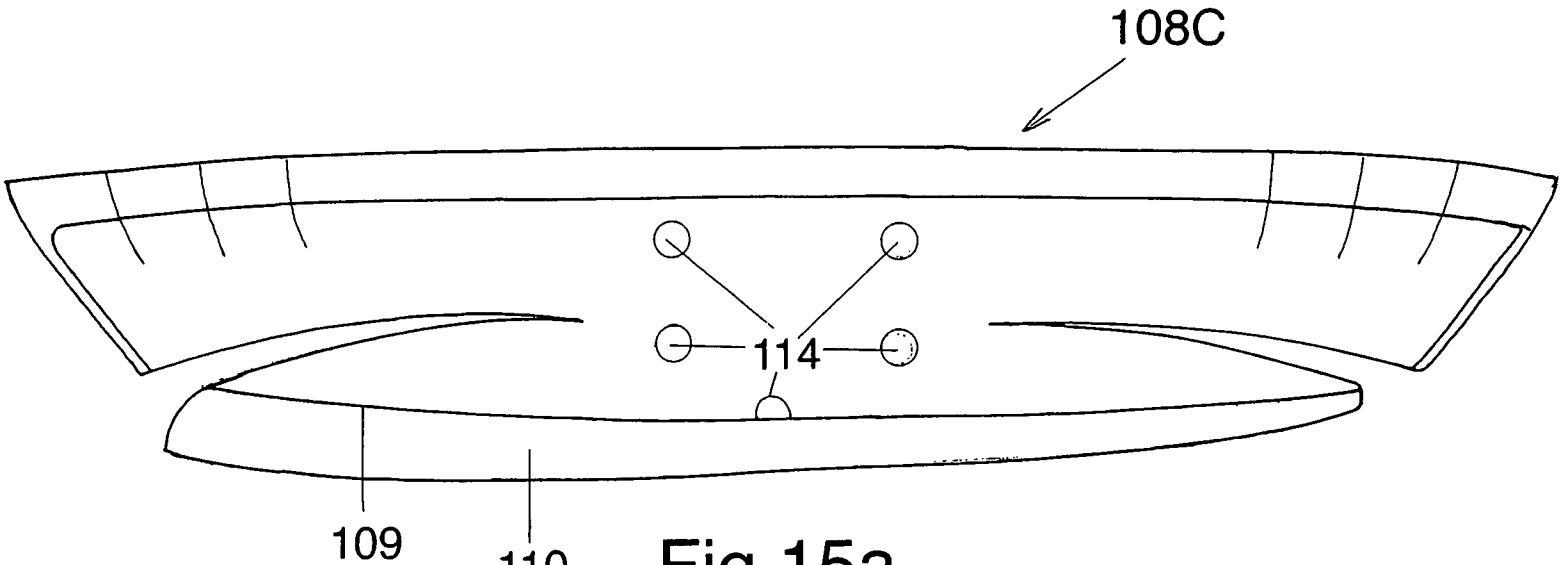

FIG. 15*a* Alternate pattern for waterproof fabric cover, right and left sides, 2 section boat, or first embodiment. This pattern is made of a single piece each, for right and left halves of the cover, with a long dart extending from the base of both the prow and stern ends into the body of the boat, to adapt the fabric pattern to the curvature of the hard hull. Smaller darts along the front and back of the hull edge, where it meets the edge of the deck, further fit the fabric cover to the boat's hard shell's curvature. All darts are reinforced with additional fabric. Thin line at upper part of pattern pieces shows edge where hull pieces join to deck pieces. Note: because middle section, if installed, as in boat's second embodiment, is perfectly straight, these patterns would work fine for second embodiment simply by extending middle section of the patterns in straight lines. I therefore have not made these additional drawings.

Figure 16A:
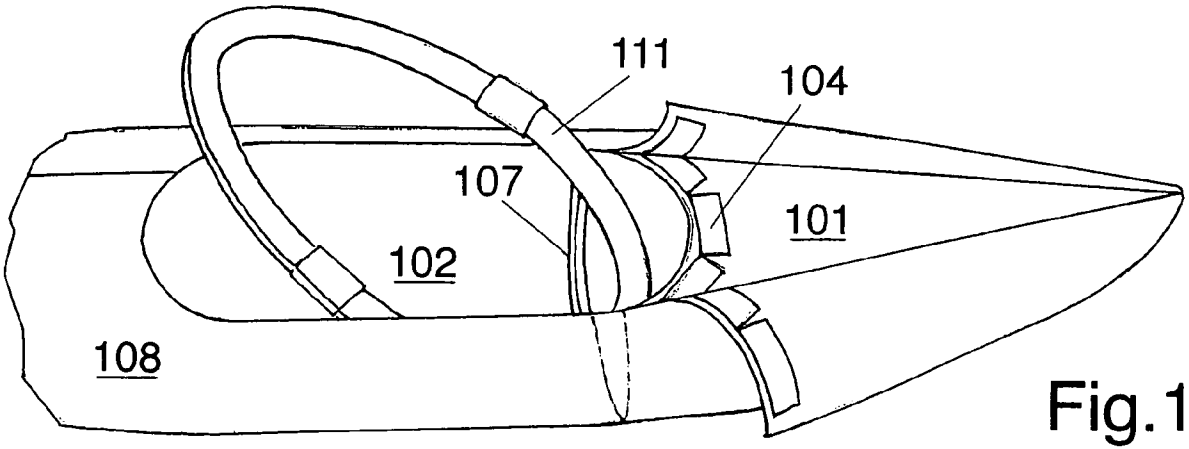

FIG. 16*a* Perspective view, from port side, first embodiment. Cover opening, both top flaps open, showing how cover attaches to cockpit with hook-and-loop strips. Releasably attachable flexible coaming ring is not yet in place.

Figure 16B:
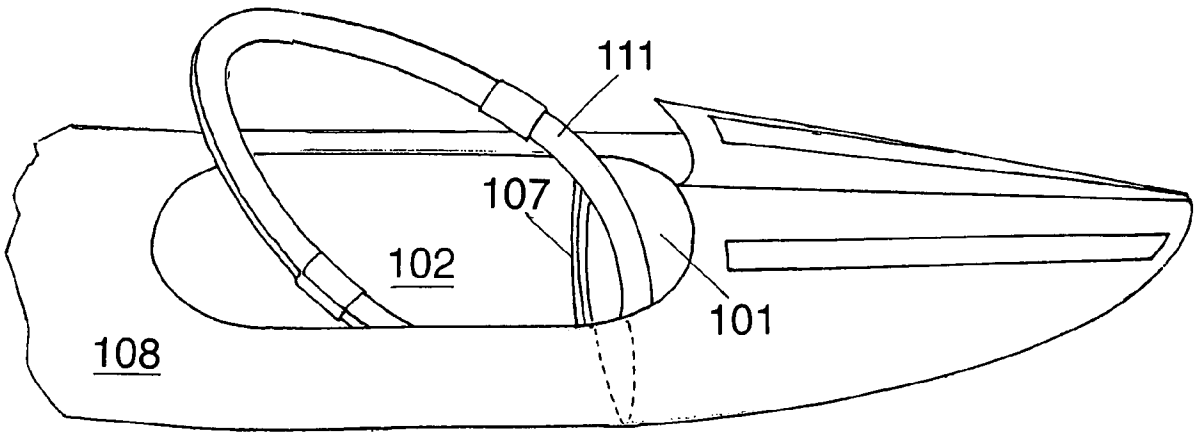

FIG. 16*b* Cover opening as above, one flap closed, showing how one flap closes over the other using hook-and-loop strip.

Figure 17:
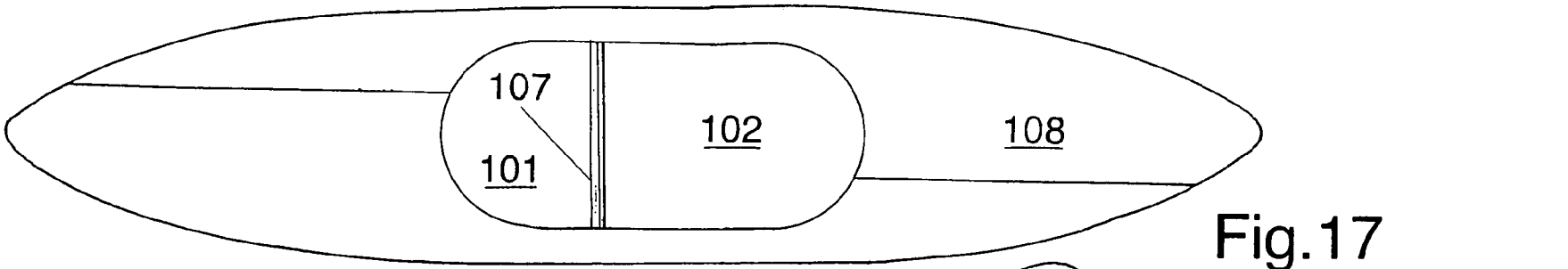

FIG. 17 Top, or plan view of first embodiment, with both cover top flaps closed, coaming ring not yet in place.

Figure 18A:
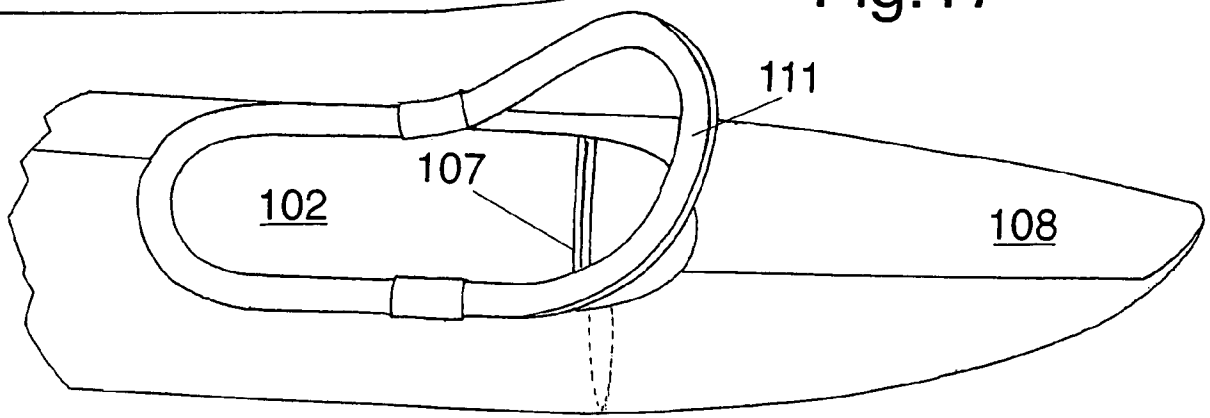

FIG. 18*a* Perspective view, from port side, first embodiment, cover flaps closed, flexible coaming ring partially in place, showing how the slit around its outer edge fits into the edge of the cockpit.

Figure 18B:
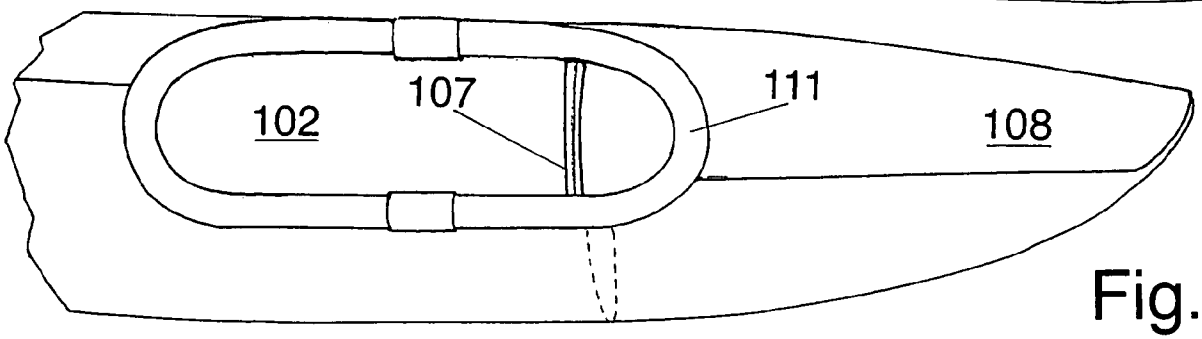

FIG. 18*b* Perspective view, as above, the flexible coaming ring in place. Note: for FIGS. 16*a* through 18*b*, second embodiment is not shown because the only difference between first and second embodiment is that the cockpit opening and the coaming around it, would be somewhat longer. The function and method of attachment would be exactly the same.

Figure 19:
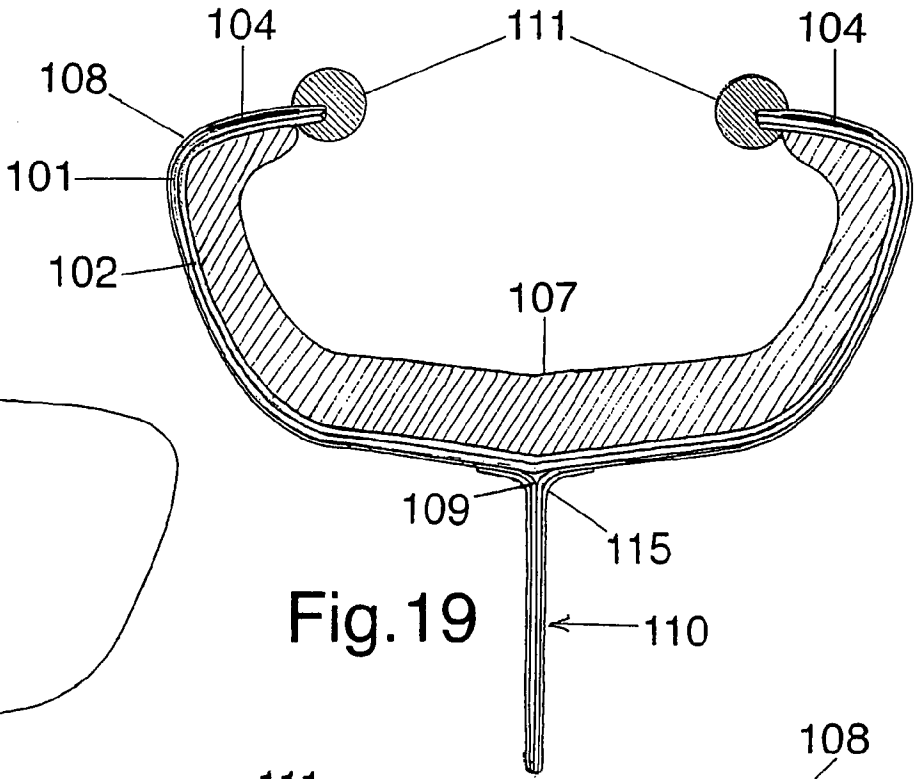

FIG. 19 Enlarged section through: the stern section rib, the stern section hull, the prow section hull (surrounding stern section hull wall) and the cover, surrounding them both. Hook-and-loop attachment between cover and edge of cockpit shows next to coaming, which grips the edge of the cockpit. Section is through the body of the boat, FIG. 14*b*', seen directly below section view, with arrows indicating location of section. Note: This shows first embodiment. Second embodiment would be the same in cross section except that the prow section hull would be replaced by the middle section, which in that case would attach to the stern.

Figure 20:
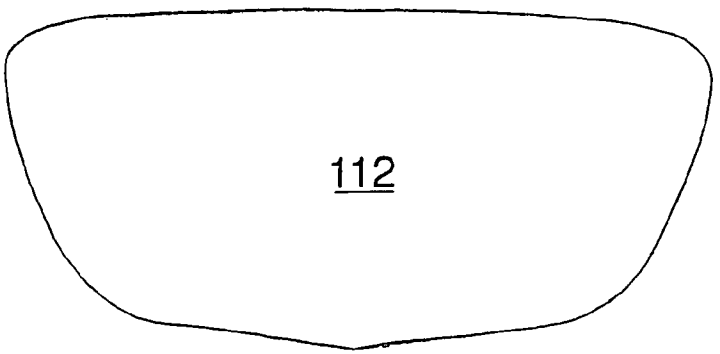

FIG. 20 Detachable "floor" used only when boat is in transport or storage mode. It is laid on top of the rib in the stern section, and holds in the cover, coaming, paddles, life vest, and other equipment stowed inside the boat, keeping them from falling out of the nested hulls.

Figure 21:
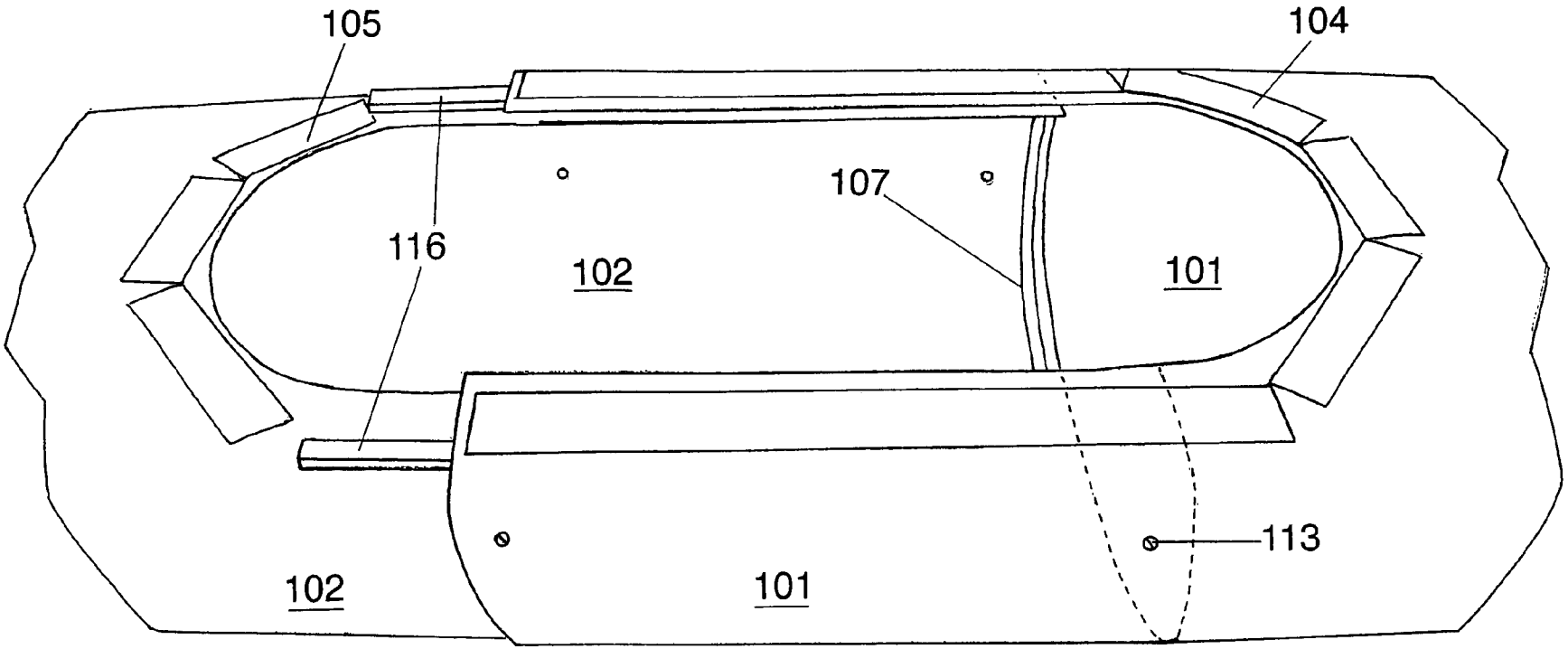

FIG. 21 Pair of tightening rods, or shims, which can be optionally slid between sections of the boat when it is ready for use, to tighten connection between them. These are only necessary if there is some "play" between the sections. As they are installed at the edge of the cockpit, they have no effect on the hull form below the water line except to make the sections fit together more snugly.

DETAILED DESCRIPTION OF THE INVENTION

First embodiment, the boat in storage and portage mode: FIG. 1*a*: The first embodiment of the boat, a kayak-type form, consists of two nearly equal halves, or collapsible rigid hull members: prow, #101 and stern, #102. This frontal view shows the boat in portage and storage mode, with stern nested within the prow, prow section completely overlapping and containing the stern section, with the fitted waterproof fabric cover, flexible releasably attachable coaming ring, and other equipment stowed inside. Around the cockpit edge are five hook and loop fastener strips #104: three short ones around the front curve of the cockpit opening edge, two long ones along the cockpit sides. These will later to be used to attach the fitted waterproof fabric cover, which has matching hook and loop fastener strips sewn to the underside of the cockpit edge. In portage mode, slipped into a simple carry bag, it can be carried like a large backpack. Or it can easily be wheeled on a luggage carrier.

FIG. 1*b* shows the nested prow and stern hull sections still together, with the cover and coaming removed, so that the removable "floor" #112, a piece of thin plywood, plastic, or other hard material, can be seen sitting like a shelf on the stern rib, #107. The floor keeps the contents of the boat: cover #108, flexible coaming #111, paddle, safety vest, et cetera, safe inside it, so they won't fall out during transport.

FIG. 2 shows a frontal view of the prow #101 and stern, #102, separated. The stern is very slightly (approximately ⅛ inch, or 3 millimeters.) smaller in all dimensions than the prow section, slides into it, and nests completely within it when the boat is in portage or storage mode. This, of course, reduces the volume by half. As in the prow section, hook and loop fastener strips, three of them, #105, are placed around the back curve of the cockpit edge, to attach the fabric cover, as described above, FIG. 1*a*. The stern rib #107 is visible at the base of the stern section.

Size and shape of hard hull sections: Dimensions for these sections can be variable according to size and preference. My prototype is as follows: the assembled and ready to paddle prototype for the first embodiment was made 9 feet., or 3 meters long, twenty-two inches. or about fifty-five centimeters wide, and eleven and a half inches. or about twenty-nine centimeters deep. In portage and storage mode the length is a little over half that of the assembled length, about five feet. or about one and two-thirds meters, taking into account about a foot of overlap, where the stern will slide into the prow and be fastened into place for use as a boat. These are only "for example" dimensions; this embodiment can be made any convenient size or shape.

An essential feature, which the reader will likely notice by looking carefully at the drawings, FIGS. 1 and 2, is that the sides of both sections are made perfectly straight from the cut edges, which here rest on the ground, up to at least two inches, or five centimeters, beyond the area of overlap, or where the prow section overlaps the stern. In order for the boat sections to fit together well, they must slide into each other like a tube sliding into a very slightly larger tube. There must by as little space as possible between sections when the boat is assembled, in order that fasteners line up, and the fit be snug and strong. The kind of fastener I envision for present art is a group of one-eighth inch, or three millimeter, corrosion proof stainless steel bolts, with matching wing nuts, disposed at intervals around the edge of prow and stern, perhaps a total of 10 or 11 of them. But any strong corrosion proof fastener would do.

Weight relating to material: With these dimensions, the total weight of the hard hull sections shown here in prototype is only fourteen pounds, or about seven kilograms. The reason for the light weight is the choice of material. While other lightweight plastics could also serve, I envision the prow and stern sections of the present art made of standard boat fiberglass cloth, eight ounce per linear yard, (at sixty inch wide fabric) or one hundred seventy grams per linear yard, (approximately one and a half plus meters wide,) and epoxy resin. Both are obtainable from West Marine, outlets in various USA locations. Most of the walls would be about 3 layers thick, reinforced to 5 or 6 layers at the bottom, the points of the prow and stern, the joint line between hull and deck, and the open edge of each section. Reinforcing the stern section is the rib, #107, made of varnished plywood or any rigid, strong material, which, in addition to holding up the aforementioned storage floor, #112, strengthens and gives rigidity to, the boat structure.

Second embodiment, three sections rather than two: FIG. 3. The second embodiment, in three sections rather than two, consists of prow #101, stern, #102, and a midsection, #103. Here they are shown slidably nested together, stern nested and contained within the prow, which is in turn slidably nested inside the middle section. FIG. 4. The midsection, #103, as is apparent from the drawing, is perfectly straight, like an open tube, where the cross section at one end is the same as in the middle or at the other end. The middle section could be any length, but taking into account the need for some overlap with prow and stern, and the desirability of a convenient length, between three and a half to four feet, or one meter fifteen centimeters to one meter thirty centimeters would do. Here, the prow #101 would be slid into and fastened to one end of the middle section, and the stern #102, would slide into and be fastened to the other end. I will discuss later, (FIG. 21) how to manage the issue of any excess space or "play" between sections should this problem arise. As above, hook and loop fastener strips, #106, along the length of the midsection would anchor the sides of the fitted waterproof fabric cover along the sides of the elongated cockpit. The second embodiment is essentially the same as the first, except for the addition of the extra middle section, which would make the boat longer. The longer deck opening would make the boat more like a hybrid between a kayak and a canoe, and allow two paddlers to ride.

First embodiment, Assembling the boat for use: When ready to use: FIG. 5; the stern section, #102, is pulled out of the prow section, #101: FIG. 6, and turned around: FIG. 7, and the open end of the stern is slid into the overlapping open end of the prow and bolted or otherwise fastened securely in place: FIG. 8. As mentioned above, If bolts and wing nuts are used, they should be of a corrosion proof material, stainless steel, for example.

Second embodiment, Assembling the boat for use: FIG. 9: Assembly for the second embodiment is the same as for the first, except with three sections instead of two. The middle section #103, is added between the prow #101 and stern #102. FIG. 10, as in FIG. 8 above, shows the sections in place, ready for use.

FIG. 11 shows the first embodiment assembled and upside down, fastened, or bolted (bolts, #113) together. FIG. 12 shows the second embodiment assembled and upside down, bolted together.

FIG. 13 shows a port side view of the second embodiment, assembled and with the fitted waterproof fabric cover #108A in place. Note #111, the elongated coaming, indicating an elongated cockpit, #109, the seam running longitudinally from the point of the prow to the point of the stern, and separating the body of the cover enclosing the hull from the flexible stabilizing keel #110. It is the addition of this keel, which is made using the extra long seam allowance from the above-mentioned seam that lets the boat have the kind of slender proportions which make it far faster, more maneuverable, and more fun to paddle than most recreational boats of this length.

About boat proportions as they relate to keels: Because size and weight are crucial to portability, a portable boat should be limited in dimensions. About the smallest a small recreational boat can be and still be considered safe is nine feet, or about three meters. But small boats are normally made extra wide, approximately one-third their length, so they won't roll excessively, or tip over. The added width makes the boat slower, less maneuverable, and less responsive. It also makes the boat heavier and more bulky, less able to fit in small spaces, like in a closet, or through the turnstiles of subway systems. This problem is solved by making the boat of the present embodiment proportionally slender but stabilizing it with a keel. Unlike most recreational boats, this one's width is only one-fifth the length for the first embodiment, and only a bit over one-sixth the length for the second. The depth is about one-tenth the length.

Keels have been in use nearly as long as boats have existed, and hard, add-on keels and skegs are sometimes used in small paddle-type boats, like kayaks and canoes. But the present embodiment is the first where a keel is actually made part of the boat cover, so that in portage and storage mode, it can be rolled up as part of the cover and stowed within the boat, saving space. Making the keel out of the fabric of the boat cover also makes it much lighter and more flexible, therefore easier to manage when assembling and disassembling the boat.

The boat cover: methods, patterns, materials, See FIGS. 13, 14A, 14*b* 15*a* and 15*b*. ref. #'s 108, 108A, 108B, 108C. Heretofore, fabric covers were usually made by draping a large piece of fabric over the upturned hull, trimming and overlapping, to make a cover which would conform to the smooth hull bottom. The present embodiment changes the design by cutting out and sewing together right and left halves of the cover, with a seam that extends from the point of the prow to the point of the stern. The resultant seam allowance is kept quite long, approximately five to six inches, or about thirteen to fifteen centimeters at the back end, to three inches, or seven and a half centimeters, toward the front; the two layers of fabric securely glued together to make the keel which hangs down from the center line of the hull, prow to stern. A further option is to reinforce the keel with a couple of additional layers of fabric glued on a bit above the seam line and extending far into the keel area or covering it. (See FIG. 19, section view of boat showing construction of keel.)

FIG. 13 shows a general view, without regard to any specific fabrication pattern, (these will be shown later) of the main parts of the cover, port side view of the second embodiment. Note: the parts and patterns of both embodiments are the same, except that the second embodiment has a longer straight middle section than the first. Main parts are: the whole cover #108A, cover seam #109, keel #110, coaming #111, and extra heavy fabric reinforcement patches #114. The reinforcement patches are glued inside and outside the cover fabric at the locations of bolts or any fasteners which might slightly project from the smooth sides of the boat, and rub against the cover. Not shown in the above drawings, but visible in the section view, FIG. 19, are optional extra layers #115, which can be added on to the outside of the keel to make it more rigid. These part numbers apply to all of the following Figures relating to the cover.

Figure 15B:
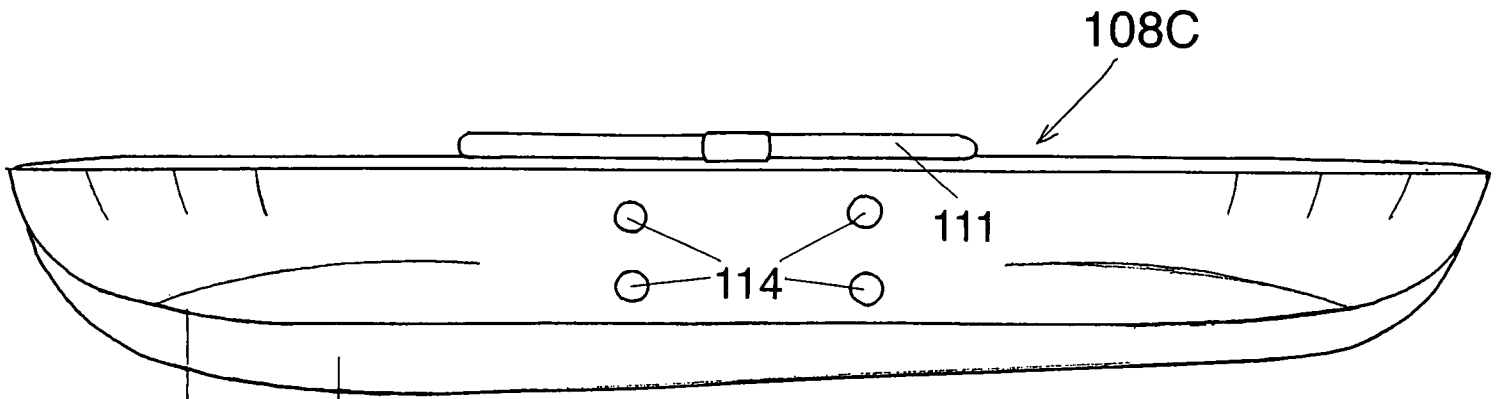

FIG. 14*a* and 14*b* show one type of suggested fabrication pattern, where the middle is a straight piece with two long sections at prow and stern, and a seam profile contoured to the profile of the bottom of the boat; and four overlapping glued pieces contoured to the curvature of the curved ends of the prow and stern. FIG. 14*a* is the exploded view of the pattern pieces, FIG. 14*b* shows a port side view of the fully fabricated cover #108*b* on the boat with coaming #111 in place, FIG. 15*a* and 15*b* show another type of suggested fabrication pattern, where the middle is a straight piece and the curves of the prow and stern are fitted using long curved darts at the sides and small straight darts where the hull meets the deck. Again, 15*a* shows an exploded view of the pattern, 15*b* shows the port side view of the fabricated cover #108C on the boat.

These patterns can be varied according to the form and degree of curvature of the hull. The inventor's prototype for first and second embodiments was made with a somewhat rounded hull form, as can be seen in FIGS. 1 through 4.

FIGS. 16*a*, 16*b*, 17: The deck, being fairly flat, is of a standard shape, with overlapping pieces attached together by hook and loop strips. FIG. 17 shows the deck, first embodiment, plan view, without coaming, with lines indicating the closed edge of the deck flaps. FIG. 16*a*, a close-up of the prow, #101 taken from a little above the port side, shows both deck flaps open, and indicates how the prow hull and the cover hook and loop strips #104 attach the cover to the edge of the cockpit. FIG. 16*b* is the same view, but one deck flap closed, and the other ready to fold over it. The coaming, #111, in both views, is not yet attached and waiting to be inserted into the edge of the cockpit. Visible in both views is the stern section #102 inserted into the prow, #101; also visible is the stern rib, #107.

There are many good choices for fabric covers; I found one good one (there are may possibilities for waterproof fabrics) to be vinyl coated polyester, which is strong, durable, resistant to ultraviolet light damage, mildew, and salt water damage, Unlike some other fabrics, it has no stretch, but is sewable and easy to glue. The vinyl glue, HH-66, is a solvent which melts the vinyl surface, so that when the vinyl surface is coated with it and pressed to another vinyl surface, they weld together permanently. This makes this fabric easy to patch in case of damage. It comes in several weights, each referring to the weight of a linear yard, thirty-five by sixty inches. or about 1 meter by one and six-tenths meters. They are: ten ounce, or about two hundred eighty=three grams, fourteen ounce, or about three hundred ninety-seven grams. eighteen ounces, or five hundred and eleven grams, and forty-two ounces. or one kilogram one hundred eighty-six grams. Because it will have the hard hull beneath it, the cover can be made of the relatively light weight fabric, just enough to keep out the water. If bolts or fasteners are used which project a bit from the smooth hard hull surface, small reinforcement patches, #114, made of a heavier weight, can protect against rubbing. Vinyl covered polyester can be obtained from several suppliers, one is Seattle Fabrics, in Washington state.

The Coaming: FIGS. 17, 18*a*, 18*b*. Added to the cover, #108, is a releasably attachable coaming, #111, made of flexible, springy material, foam being one good choice, formed in a fitted ring with a slit running all the way around the outside edge. The slit opens the coaming, so that it can fit over the edge of the cockpit opening. It is necessary to snugly fit the coaming ring to the opening, so that it will form a tight joint which will repel splashes. Many kinds of material could be suitable; I have found that soft foam closed cell neoprene pipe insulation, available in varying sizes, for example: two inches, or five centimeters outer dimension, and one inch, or two and a half centimeters inner dimension, or, if a larger diameter is desired, two inches. or seven and a half centimeters outer dimension, and one and a half inches, or three and three quarters centimeters inner dimension. A nice feature of this kind of coaming is that the paddler can interchange coaming sizes based on weather conditions or personal preference. FIG. 17 shows the deck ready for the coaming to be put in. FIG. 18*a* shows the coaming partly fitted into the cockpit opening, FIG. 18*b* shows the coaming fully installed.

How the parts fit together FIG. 19 is an enlarged section through the first embodiment at the stern rib #107, at the point indicated by the arrows on the repeated image of FIG. 14*b*. it shows the layers of the hull sections and cover, and the construction of the keel. Over the rib and attached to it is the stern section hull, #102; over the stern section hull and fastened to it is the prow section hull #102, and around them both is the cover #108, attached to the cockpit edge by hook and loop strips, #104. The right and left halves of the cover are sewn and glued together, the seam allowance forms the keel #110. Optional additional pieces #115 can be glued to the sides of the keel, and extending up about three-quarters of an inch. or two centimeters. over the seam #109, strengthening and completely waterproofing the seam and making the keel more rigid. At the edges of the cockpit is the coaming ring #111.

FIG. 20 shows a plan view in the same relative size as the section above, of the temporary "floor" which can be inserted, shelf-like, over the stern rib #107 to hold in the contents of the boat during portage and storage, i.e. cover, coaming, paddles, et cetera. (see also above, FIGS. 1*a*, 1*b*, and 2.)

Holding the sections together, an option, the shim or spacer bar: FIG. 21: In the second embodiment, the prow is slightly larger than the stern, and the middle section is slightly larger than the prow. Thus there may be a bit more space between middle section and stern than between middle section and prow. Extra space, or "play" between sections is easily handled by inserting a thin "shim" or spacer bar #116, between the sections right next to the edge of the cockpit, to make the fit as tight as possible. Since the material making up the sections, for example thin walled fiberglass and epoxy resin, or a similar kind of material, should have some slight lateral flexibility, this shim will make the fit tight and firm.

A few general observations regarding this invention. Mentioned in Background of the Invention are problems which portable boats attempt to solve. The present invention solves all of them.

1. Portability and convenience: The present art is light weight and small sized. With the full fabric cover and coaming, the total weight of my experimental prototype is twenty-five pounds or less. The second embodiment, depending on the length of the middle section, would be proportionally more, perhaps a third more. The slender profile and short length allows the boat to fit onto many forms of public transportation, (through subway turnstiles, for example) and into car trunks. It is portable backpack style or on a luggage carrier. It can be stored easily, and the nested hulls make an ideal container for the cover, coaming, paddles, life vest and other equipment and supplies. Assembly is rapid and easy, (i have timed it at fifteen minutes, without rushing) as there are only two or three hull parts to attach together with a few bolts or other fasteners each. The cover and coaming slip on easily and snug on tightly because of the hook and loop fastenings on the cover, and the flexibility of the coaming. After the trip, disassembly is even easier and more rapid, and, because the materials used to make the boat, cover and coaming dry very fast and have little tendency to mildew, a simple wipe-down with a towel and a few minutes dry time prepares the boat for storage.

2. Safety: The present art is a safe boat because it is stable, durable, and easy to repair. The keel described above greatly increases the boat's resistance to rolling and tipping. Unlike skinboats, mid-voyage punctures are a minor concern, because the cover, rather than being backed up by empty air, is backed up by a hard wall. The hard wall will effectively resist punctures, as it will resist entry by a sharp object. Should a breach occur, it would be much smaller than it would be in the case of a skinboat, and water pressure would push any breach in the cover against the hull wall, which would block the inrush of water, resulting in only a slow leak, not a disaster. Fiberglass, one good choice for the hull, and used for many kinds of watercraft, is one of the most durable of boat materials. It is easy to repair using the kind of simple tools found in any home. Vinyl covered polyester fabric, one good choice for the cover, is also highly resistant to damage and wear of all kinds, and is easy to repair using a simple glue patch. The HH-66 vinyl cement welds two vinyl surfaces permanently together in a moment, good as new or even stronger.

Figure 14B:
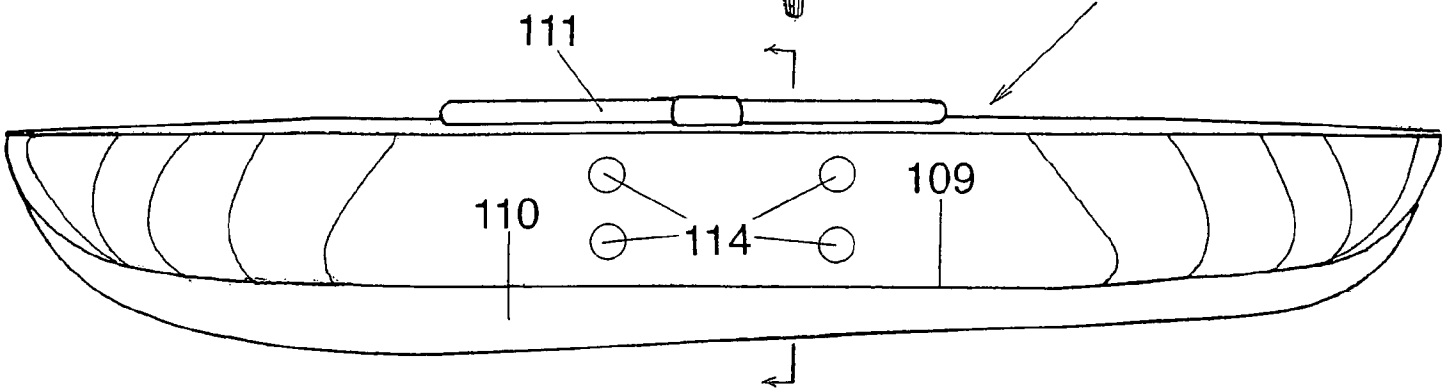

3. Cost. The present art has few parts, and the materials to make them are easily obtainable and inexpensive. Molding the prow and stem parts involve only making one form for the stern, and adding a thin layer to it for the prow, I made the stern prototype model of hard styrofoam, and added an all-over 3/16 inch or 4 millimeter, approximately, layer of thin foam-core board strips and corrugated cardboard to make the slightly larger in all dimensions prow model. The form of the boat can vary, from a rounded prow and stern, as in the present art, to a more V shaped prow and stern. The hull form would dictate the cover pattern, but I offer two possible designs. (See FIGS. 14, 15) Sewing the right and left sides together is simple, as are cutting and joining the overlapping darts or curved pieces of the hull patterns. Having a straight middle to the boat makes construction simpler. The deck pieces, two for the prow and two for the stern, allowing them to overlap and close with hook and loop strips, are laid flat and glued onto the upper edge of the hull cover, The coaming is simplest of all, just joining tubular foam end to end to make the ring, and slitting around the outside edge. There are no special little parts to break or get lost, just a few standard stainless steel bolts and wing nuts, obtainable through any large hardware supplier. That's it.

REFERENCE NUMBERS

101 Prow section of boat. This is a hard shell, made of fiberglass plus resin or some other suitable plastic.

102 Stern section of boat. Also a hard shell. The 2 part boat, kayak-like in form, is the first embodiment, where the two parts are slid, one into the other, prow section overlapping the stern, detachably and releasably secured together.

103 Mid section of boat. Also a hard shell. This is added between above sections in the second embodiment. Instead of attaching the two above sections together, this midsection is releasably attached between them, making a longer boat, with a longer cockpit. As it separates prow and stern section, It makes the cockpit opening much longer, and becomes similar to a kayak-canoe hybrid, or "kayacanoe", which would have a more open deck.

104 Group of 5 hook-and-loop strips attached around the edge of the prow section cockpit, to attach the fabric cover to it. There are 3 pieces around the front curve of the cockpit, and 2 along the sides. They releasably attach to hook-and-loop strips around the inside of the cockpit edge of the waterproof fabric cover.

105 Group of 3 hook-and-loop pieces attached around the edge of the stern section cockpit to attach the fabric cover to it, same way as above.

106 Hook-and-loop strips along the sides of 103, the mid section, second embodiment, for the purpose of attaching cover as above.

107 Rib around the inner edge of the stern section. Its purpose is to strengthen and give rigidity to the middle of the boat, and to give a support structure to a "floor" piece which can be inserted into the stern section when the boat is in transport or storage mode. It may be made of any strong, rigid material: plywood, plastic, et cetera.

108 Waterproof fabric cover of the boat. This is a general designation for the whole cover assembly. More specific embodiments (different patterns) are designated by 108 plus suffix numbers.

108A Fabric cover for longer version (3 section) kayak-canoe hybrid or kayacanoe. This shows a general view with the body of the cover, the seam (109) joining right and left sides of the cover, which separates the body of the cover from the stabilizing keel (110) at the bottom of the boat It does not show a sewing pattern as do #'s 108B, 108C.

108B Fabric cover, first embodiment of the pattern design for the hull pieces.

108C Fabric cover for second embodiment of the pattern design. Note: pattern design can vary widely depending on the form of the boat. These are for a somewhat rounded configuration of the hull. Thin lines at upper part of fabric pattern pieces are where hull pieces would join to the deck pieces of the cover.

109 Seam attaching the right and left sides of the kayak cover to each other, running the length of the boat's hull, from the point of the prow to the point of the stern. This seam divides the part of the cover which goes around the body of the kayak from the stabilizing fabric keel, made using the seam allowance.

110 Stabilizing flexible keel, made using the wide seam allowance cited above. This keel helps to keep the boat from rocking excessively or tipping over, and allows the boat to be made proportionally far more slender, therefore faster and more maneuverable, than the vast majority of small recreational boats of a similar length (approximately 9 feet or 3 meters).

111 Coaming, made of flexible material usually in a tubular form, (foam, for example,) formed in a ring fitted to the cockpit opening and split down its outer edge so that the cut edges grip the edge of the cockpit, and hold stably during use, to protect the paddler from waves and splashes.

112 "Floor" piece, which can be inserted into the stern section, held up by its rib (see #107), when boat is in transport or storage mode. This piece allows the paddler to stow the fabric cover, coaming, paddles, and any other needful equipment inside the body of the boat, with no danger of their falling out.

113 Fasteners, or bolts holding sections of the boat together. (They can be any convenient size; ⅛th inch or approximately 3 millimeters, is good.) The number of fasteners, or bolts and wing nuts, can vary, as long as they hold sections together stably. Another type of fastener is acceptable, but bolts are convenient and easy and wing nuts are more readily tightened without tools. They should be stainless steel, resistant to rust or rustproof.

114 Reinforcement patches in cover, preferably inside and outside, made of heavy duty fabric, to protect cover surface from rubbing by fasteners.

115 Extra fabric pieces glued on to sides of the cover seam, and onto the flexible keel, to waterproof and seal the seam and make the keel stiffer. These would extend a short distance over the seam into the cover area, and far into the keel area.

116 Thin rod spacing "shims" slid between sections of the boat at the edges of the cockpit, to make the sections fit more tightly. This part is optional and only used if the sections have too much "play" between them, and need something wedged into the sides of the cockpit where sections overlap, to tighten the connection. They do not change the boat's configuration below the water line, and serve only to snug up the fit between sections.

I claim:

1. A collapsible rigid hull sectional boat assembly comprising:

a. An outer surface;

b. At least two collapsible rigid hull members;

i. Said hull members comprising:

a) a prow and a stern, whereby said prow and said stern are slidably nested together;

b) a cockpit;

i) Said cockpit having an opening;

ii) Said cockpit opening have an edge;

iii) Said edge having a plurality of hook and loop fasteners;

c. A bottom;

d. A waterproof, fitted fabric cover:

i. Said cover having a bottom, a top, an edge, and a seam;

a) Said seam located at said bottom of said cover running longitudinally along said bottom of said boat and forming a flexible stabilizing keel;

ii. Said edge having hook and loop fasteners;

e. A flexible releasably attachable coaming.

2. The collapsible rigid hull sectional boat assembly of claim 1, wherein:

a. Said hook and loop fasteners of said fabric are releasably attached to said hook and loop fasteners around said edge of cockpit opening such that said fabric covers said outer surface of said boat;

b. Said coaming is releasably attached to said edge of said boat's cockpit opening.

3. The collapsible rigid hull sectional boat assembly of claim 1, wherein said boat's section members comprise three sections: a prow, a middle and a stern, whereby said prow, said middle and said stern are slidably nested together.

4. The collapsible rigid hull sectional boat assembly of claim 1, wherein shims are inserted between said boat's sections at said boat's cockpit edge.

5. The collapsible rigid hull sectional boat assembly of claim 1, wherein said coaming is a flexible ring having an outer edge with a slit that is attachably fitted to said edge of said cockpit.

* * * * *